US008151403B2

(12) United States Patent
Wada et al.

(10) Patent No.: US 8,151,403 B2
(45) Date of Patent: Apr. 10, 2012

(54) CLEANING IMPLEMENT

(75) Inventors: Minoru Wada, Tochigi (JP); Hiroyuki Yanagida, Tokyo (JP); Keima Takabayashi, Tochigi (JP); Hidesato Kizaki, Tokyo (JP); Tomohisa Hirata, Tokyo (JP)

(73) Assignee: Kao Corporation, Tokyo (JP)

( * ) Notice: Subject to any disclaimer, the term of this patent is extended or adjusted under 35 U.S.C. 154(b) by 917 days.

(21) Appl. No.: 12/083,837

(22) PCT Filed: Oct. 6, 2006

(86) PCT No.: PCT/JP2006/320052

§ 371 (c)(1),
(2), (4) Date: May 19, 2008

(87) PCT Pub. No.: WO2007/046252

PCT Pub. Date: Apr. 26, 2007

(65) Prior Publication Data

US 2009/0255078 A1 Oct. 15, 2009

(30) Foreign Application Priority Data

Oct. 19, 2005 (JP) ..... 2005-304794

(51) Int. Cl.
*A47L 13/10* (2006.01)

(52) U.S. Cl. ..... 15/229.4; 15/147.2; 15/226

(58) Field of Classification Search ..... 15/147.1, 15/147.2, 226, 228, 229.3, 229.4, 229.7, 15/229.8; *A47L 13/10, 13/16*

See application file for complete search history.

(56) References Cited

U.S. PATENT DOCUMENTS 333,650 A 1/1886 Mason (Continued)

FOREIGN PATENT DOCUMENTS

CN 1350442 A 5/2002

(Continued)

OTHER PUBLICATIONS

Chinese Office Action mailed Nov. 27, 2009 in Chinese Application No. 200680004373.X.

(Continued)

*Primary Examiner* — Mark Spisich
*Assistant Examiner* — Michael Jennings
(74) *Attorney, Agent, or Firm* — Birch, Stewart, Kolasch & Birch, LLP

(57) ABSTRACT

A cleaning implement 1 including a cleaning article 10 having a pocket 15 and a holder 20 adapted to be inserted into the pocket 15 to hold the cleaning article 10. The pocket 15 of the cleaning article 10 has a counter bumping portion 18 in the middle between the inlet opening at one end and the opposing end thereof. The holder 20 includes a handle 21, an insertion portion 22 extending from one end of the handle 21, and a retaining means 24 for retaining the vicinity of the inlet opening of the cleaning article 10. The insertion portion 22 has a bumping portion 23 that allows the insertion portion 22 to be inserted into the pocket 15 with no substantial obstruction until it reaches a bumping position where it bumps against the counter bumping portion 18 and then restricts further insertion beyond the bumping position. The cleaning article 10 is substantially prevented from moving between the bumping portion 23 and the retaining means 24 when it has the insertion portion 22 inserted into the pocket 15 and is retained by the retaining means 24.

11 Claims, 8 Drawing Sheets

U.S. PATENT DOCUMENTS

| | | | | | |
|---|---|---|---|---|---|
| 534,839 | A | | 2/1895 | Nelsen | |
| 597,158 | A | | 1/1898 | Willey | |
| 810,708 | A | | 1/1906 | Brister | |
| 974,922 | A | | 11/1910 | Rose | |
| 975,862 | A | | 11/1910 | Hatosy | |
| 1,375,102 | A | | 4/1921 | Masser | |
| 1,416,480 | A | | 5/1922 | Leatherman | |
| 1,437,145 | A | | 11/1922 | Johnson | |
| 1,637,595 | A | | 8/1927 | Sturgis | |
| 2,062,065 | A | | 11/1936 | Miley | |
| 2,151,425 | A | | 3/1939 | Gregory | |
| 2,172,479 | A | | 9/1939 | McMillen | |
| D151,623 | S | | 11/1948 | Heller | |
| 2,816,313 | A | * | 12/1957 | Beck et al. | 15/210.1 |
| 2,998,614 | A | * | 9/1961 | Winch | 15/210.1 |
| 3,066,344 | A | | 12/1962 | Borras et al. | |
| D226,886 | S | | 5/1973 | Codina | |
| 4,099,289 | A | * | 7/1978 | Bretthauer | 15/244.1 |
| D294,073 | S | | 2/1988 | Lin | |
| D320,878 | S | | 10/1991 | Linder | |
| D350,029 | S | | 8/1994 | Murphy et al. | |
| D353,489 | S | | 12/1994 | Hurwitz | |
| D353,940 | S | | 1/1995 | Joyner et al. | |
| 5,605,941 | A | | 2/1997 | Steinmann et al. | |
| 5,953,784 | A | | 9/1999 | Suzuki et al. | |
| D435,948 | S | | 1/2001 | Long | |
| 6,329,308 | B1 | | 12/2001 | Kenmochi et al. | |
| 6,978,509 | B2 | * | 12/2005 | Lin | 15/229.7 |
| D515,319 | S | | 2/2006 | Ashley et al. | |
| D530,051 | S | | 10/2006 | Treacy | |
| 7,219,386 | B2 | * | 5/2007 | Tsuchiya et al. | 15/144.4 |
| 7,293,317 | B2 | * | 11/2007 | Tsuchiya et al. | 15/147.2 |
| 7,739,770 | B2 | * | 6/2010 | Tanaka et al. | 15/228 |
| 7,779,502 | B2 | * | 8/2010 | Fujiwara et al. | 15/229.4 |
| 7,786,030 | B2 | * | 8/2010 | Tsuchiya | 442/123 |
| 7,937,797 | B2 | * | 5/2011 | Tsuchiya et al. | 15/229.3 |
| 2002/0148061 | A1 | * | 10/2002 | Tanaka et al. | 15/229.3 |
| 2004/0016074 | A1 | | 1/2004 | Tanaka | |
| 2004/0034956 | A1 | * | 2/2004 | Tanaka et al. | 15/229.4 |
| 2005/0005381 | A1 | * | 1/2005 | Tanaka et al. | 15/147.2 |
| 2006/0016036 | A1 | | 1/2006 | Tanaka et al. | |
| 2006/0171764 | A1 | | 8/2006 | Hoadley | |
| 2006/0230560 | A1 | | 10/2006 | Sampaio | |
| 2006/0282969 | A1 | | 12/2006 | Yamada | |
| 2007/0113365 | A1 | | 5/2007 | Parkinson | |
| 2007/0174987 | A1 | | 8/2007 | Yamada | |

FOREIGN PATENT DOCUMENTS

| | | | |
|---|---|---|---|
| CN | 1386059 | A | 12/2002 |
| CN | 1628591 | A | 6/2005 |
| DE | 103 60 755 | A1 | 7/2005 |
| EP | 1201175 | A1 | 5/2002 |
| GB | 1417293 | A | 12/1975 |
| JP | 48-30851 | A | 9/1973 |
| JP | 51-21542 | A | 6/1976 |
| JP | 461574 | | 11/1977 |
| JP | 55-45980 | A | 3/1980 |
| JP | D578348 | | 6/1982 |
| JP | 57-160457 | A | 10/1982 |
| JP | D724281 | | 2/1988 |
| JP | 2-4541 | U | 1/1990 |
| JP | 3-58260 | U | 6/1991 |
| JP | D877507 | | 9/1993 |
| JP | 6-294167 | A | 10/1994 |
| JP | 9-135798 | A | 5/1997 |
| JP | 3043196 | U | 8/1997 |
| JP | 10-248781 | A | 9/1998 |
| JP | 3053594 | U | 11/1998 |
| JP | 11-47059 | A | 2/1999 |
| JP | 2001-276125 | A | 10/2001 |
| JP | D1145957 | | 7/2002 |
| JP | 2002-369783 | A | 12/2002 |
| JP | 2003-265390 | A | 9/2003 |
| JP | 2004-298650 | A | 10/2004 |
| JP | 2005-137931 | A | 6/2005 |
| JP | 2005-237589 | A | 9/2005 |
| JP | 2005-237591 | A | 9/2005 |
| JP | 2005-237975 | A | 9/2005 |
| JP | 2005-261731 | A | 9/2005 |
| WO | WO-02/34101 | | 5/2002 |
| WO | WO-2005/099549 | A1 | 10/2004 |
| WO | WO 2005/092171 | A1 | 10/2005 |
| WO | WO 2006/011234 | A1 | 2/2006 |

OTHER PUBLICATIONS

Japanese Decision of Refusal for Application No. 2006-186230, dated Mar. 1, 2011.

Extended European Search Report issued May 6, 2010 in European Application No. 06811379.4-2316/1938738 PCT/2006320052.

European Extended Search Report in European Application No. 06811378.6 mailed Apr. 1, 2010.

European Search Report in European Application No. 06823156.2 mailed May 11, 2010.

Notice of Rejection in Japanese Application No. 2005-305697 mailed Apr. 27, 2010.

Notice of Rejection in Japanese Application No. 2006-064304 mailed Jun. 8, 2010.

Notice of Rejection in Japanese Application No. 2006-186230 mailed Jun. 29, 2010.

Notice of Rejection in Japanese Application No. 2006-281743 mailed Jun. 29, 2010.

Singapore Search Report in Singapore Application No. 2008028375 mailed Jul. 2, 2009.

Singapore Search Report and Written Opinion issued May 28, 2009 by the Danish Patent and Trademark Office for corresponding Singapore Application No. 200802786-4.

Chinese Office Action issued in the corresponding Chinese Application No. 2006800390114, dated Jul. 24, 2009.

Japanese Office Action for Application No. 2006-064304 dated Mar. 29, 2011.

Singapore Written Opinion and Search Report for Application No. 200705798-7 dated May 28, 2010.

U.S. Notice of Allowance for U.S. Appl. No. 29/270,555 dated Apr. 29, 2008.

U.S. Notice of Allowance for U.S. Appl. No. 29/270,556 dated Apr. 29, 2008.

U.S. Office Action for U.S. Appl. No. 11/884,130 dated Aug. 24, 2011.

U.S. Office Action for U.S. Appl. No. 11/884,130 dated Feb. 9, 2011.

U.S. Office Action for U.S. Appl. No. 11/884,130 dated Mar. 16, 2011.

U.S. Office Action for U.S. Appl. No. 12/083,839 dated Apr. 28, 2011.

U.S. Office Action for U.S. Appl. No. 12/083,839 dated Nov. 9, 2010.

U.S. Office Action for U.S. Appl. No. 29/270,557 dated Apr. 24, 2008.

Office Action for European Patent Application No. 06823156.2, dated Jan. 24, 2012.

Office Action for European Patent Application No. 06811378.6, dated Jan. 27, 2012.

* cited by examiner

CLEANING IMPLEMENT

TECHNICAL FIELD

The present invention relates to a cleaning implement including a holder and a cleaning article.

BACKGROUND ART

Cleaning implements having a holder and a cleaning article are widely known, the holder being attachably inserted in a holder-receiving pocket of the cleaning article. Because the cleaning implement of this type is used while gripped by the handle of the holder, it is easy to adjust the force of applying the brush, etc. of the cleaning article to a surface of an object being cleaned, which provides improved maneuverability of the cleaning implement.

Some cleaning implements have the holder-receiving pocket of the cleaning article made narrower than the insertion portion of the holder so that the cleaning article may not come off the holder while the handle is gripped during a cleaning operation. However, such cleaning implements cause a user difficulty in inserting the holder into the pocket on use and removing the holder from the pocket after use. If, on the other hand, the pocket of the cleaning article is wider than the insertion portion of the holder, the holder can easily be inserted into the pocket but, in turn, holder easily comes off the pocket. That is, the cleaning article can be detached from the holder during a cleaning operation, causing a user trouble.

To solve the problem, cleaning implements designed to help insert a holder into a holder-receiving pocket of a cleaning article by taking advantage of elastic deformation of the insertion portion of the holder have been proposed.

For example, JP 2003-265390A discloses a cleaning implement including a wipe (cleaning article) and a wipe holder. The holder includes a pair of plastic insertion plates extending in parallel with each other that are to be inserted in the pocket of the wipe. Each of the insertion plates has two projections formed integrally with the plate and spaced apart in the longitudinal direction on the outboard edge of the plate. The wipe as a cleaning article has two holder-receiving pockets extending in parallel with each other. Each of the pockets has its longitudinally middle region narrowed by the presence of a fused line. When the pair of insertion plates are inserted into the respective pockets, they are elastically deformed inward, and, after the leading projections slide with the respective fused lines at a small contact area, the holder is secured to the wipe with the narrowed portion being positioned between the two projections.

The patent document 1: JP2003-265390A

According to the wipe disclosed in JP 2003-265390A, the pair of insertion plates each have projections on their outboard edges, and the insertion plate-receiving pockets each have a bottleneck region in which a fused line is formed to make that region narrower than the width of the insertion plate inclusive of each projection. Because the insertion plates inserted into the respective pockets are snapped into position after the leading projection passes through the bottleneck region, the sliding between the projections of the insertion plates and the bottleneck region of the pockets generates a considerable load. Therefore, the projections can be caught in the pockets, the insertion plates can bend, and, in some cases, the pockets can be broken.

DISCLOSURE OF THE INVENTION

The present invention provides a cleaning implement including a cleaning article and a cleaning article holder. The cleaning article has a pocket in which the holder is adapted to be inserted. The pocket of the cleaning article has an inlet opening through which the holder is to be inserted at one end thereof and the opposite end in the direction of inserting the holder. The pocket has a counter bumping portion in the middle between the inlet opening and the opposing end thereof. The holder includes a handle, an insertion portion extending from one end of the handle and adapted to be inserted into the pocket of the cleaning article, and a retaining means that is adapted to retain the vicinity of the inlet opening of the cleaning article when the insertion portion is inserted into the pocket. The insertion portion has a bumping portion that allows the insertion portion to be inserted into the pocket with no substantial obstruction until it reaches a bumping position where it bumps against the counter bumping portion of the pocket and then restricts further insertion of the insertion portion beyond the bumping position. When the insertion portion is inserted into the pocket, and the cleaning article is retained by the retaining means, the cleaning article is substantially prevented from moving between the bumping portion and the retaining means.

BRIEF DESCRIPTION OF THE DRAWING

FIG. 3(*b*) is a plan view of the holder of FIG. 3(*a*).

FIG. 3(*c*) is a side view of the holder of FIG. 3(*a*).

FIG. 8(*b*) is a plan view of the holder of FIG. 8(*a*).

FIG. 8(*c*) is a side view of the holder of FIG. 8(*a*).

FIG. 14(*b*) is a plan view of a pair of substrate sheets of a cleaning article of a cleaning implement according still another embodiment of the present invention, with a holder being inserted therebetween.

FIG. 14(*c*) is a plan view of a pair of substrate sheets of a cleaning article of a cleaning implement according still another embodiment of the present invention, with a holder being inserted therebetween.

FIG. 15(*b*) illustrates a holder of a cleaning article of a cleaning implement according to still another embodiment of the present invention.

DETAILED DESCRIPTION OF THE INVENTION

Figure 1:
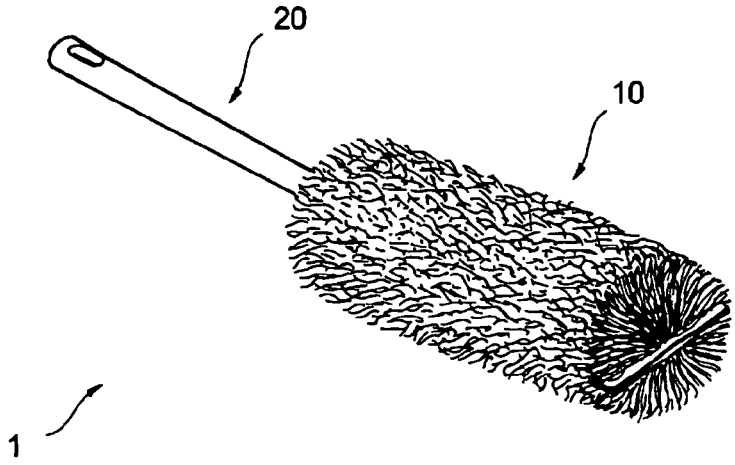
FIG. 1 is a perspective view of a cleaning implement according to a first embodiment of the present invention.

The present invention will be described in detail based on its first preferred embodiment of a cleaning implement 1 of the invention with reference to FIGS. 1 through 6.

As illustrated in FIGS. 1 through 4, the cleaning implement 1 of the present embodiment includes a cleaning article 10 (hereinafter referred to as a mop 10) having a pocket 15 and a holder 20 that is adapted to be inserted into the pocket 15 to hold and support the mop 10.

Figure 3A:
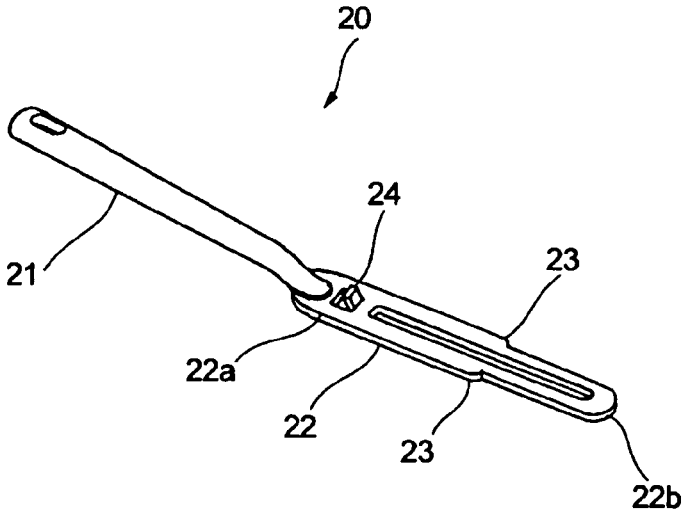
FIG. 3(*a*) is a perspective view of a holder of the cleaning implement according to the first embodiment of the present invention.
Figure 3B:
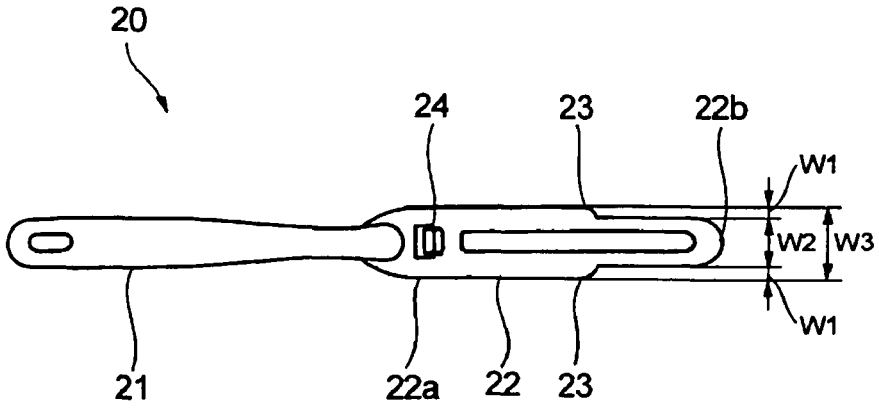
Figure 3C:
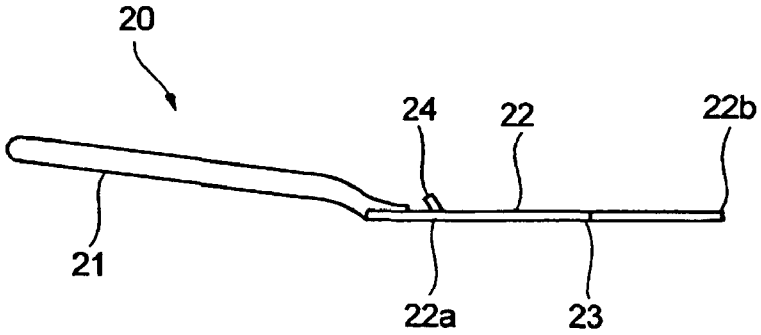
Figure 4:
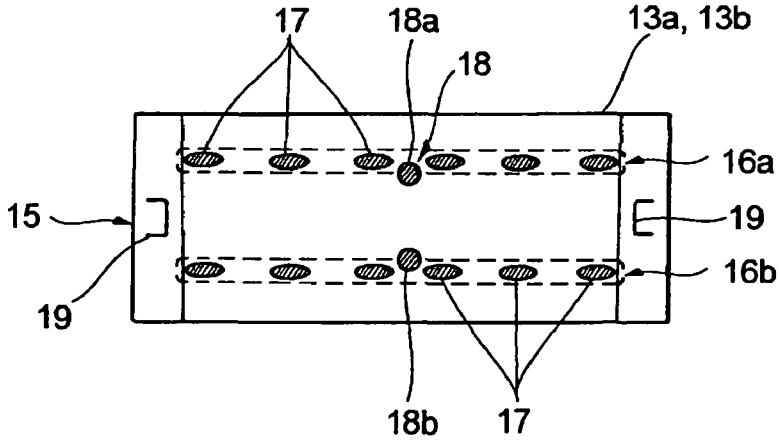
FIG. 4 is a plan view of a pair of substrate sheets of the cleaning article used in the cleaning implement according to the first embodiment of the present invention.

The mop 10 has a pair of substrate sheets 13*a* and 13*b*. As illustrated in FIG. 4, the pocket 15 is formed by joining the two substrate sheets 13*a* and 13*b* overlying each other. As illustrated in FIGS. 3(*a*) to 3(*c*), the holder 20 includes a handle 21, an insertion portion 22 that extends from one end of the handle 21 and is adapted to be inserted into the pocket 15, and a retaining means 24 adapted to retain the vicinity of the inlet opening of the mop when the insertion portion 22 is inserted into the pocket 15.

The insertion portion 22 of the holder 20 has a bumping portion 23. The bumping portion 23 allows the insertion portion 22 to be inserted with no substantial obstruction until the bumping portion 23 bumps into a counter bumping portion 18 of the pocket 15 at a bumping position and restricts further insertion of the insertion portion 21 beyond the bumping position. More specifically, the insertion portion 22 has a proximal end 22*a*, a distal end 22*b*, and a bumping portion 23 in the middle between the proximal end 22*a* and the distal end 22*b*. The pocket 15 has the counter bumping portion 18 in the middle between an inlet opening at one of the ends thereof through which the holder 20 is adapted to be inserted and the opposite end in the direction of inserting the holder 20.

With the insertion portion 22 inserted in the pocket 15, and with the mop 10 caught on the retaining means 24, the mop is substantially prevented from moving between the bumping portion 23 and the retaining means 24.

The expression "the mop is substantially prevented from moving" as used herein is intended to include a situation that the mop is perfectly prevented from moving between the bumping portion 23 and the retaining means 24 and a situation that the mop is allowed to move within an allowance, a permissible positional difference between the vicinity of the inlet opening of the mop 10 and the retaining means 24 of the holder 20. The latter situation will be described later.

The cleaning implement 1 of the present embodiment will further be described. The bumping portion 23 is formed by making a difference in width or cross-sectional area of the insertion portion 22 in the middle between the proximal end 22*a* and the distal end 22*b* so that the region of the insertion portion 22 distal to the bumping portion 23 (hereinafter sometimes referred to as distal end (22*b*) side portion) has a smaller width or cross-sectional area than the counter bumping portion 18 and is therefore capable of passing through the counter bumping portion 18. The region of the insertion portion 22 proximal to the bumping portion 23 (hereinafter sometimes referred to as proximal end (22*a*) side portion) has a smaller width or area than the inlet opening of the pocket 15 and a larger width or cross-sectional area than the counter bumping portion 18.

In more detail, when the insertion portion 22 of the holder 20 is inserted through the inlet opening at one end of the pocket 15, the bumping portion 23 bumps against the counter bumping portion 18 to restrict further insertion of the insertion portion 22 beyond the bumping position. The counter bumping portion 18 is a part at which the bumping portion 23 bumps and is provided inside the pocket 15. The bumping portion 23 is a part provided in the middle between the proximal end 22*a* and the distal end 22*b* of the insertion portion 22 at which the width or thickness (cross-sectional area) of the insertion portion 22 changes such that the region proximal to the bumping portion 23 is wider or thicker and bumps against the counter bumping portion 18 and is prevented from moving in the insertion direction and the direction perpendicular thereto. The bumping portion 23 is preferably a pair of shoulders making a difference in width as illustrated in FIG. 3. The region from the bumping portion 23 to the distal end 22*b* has a smaller width or thickness than the region from the bumping portion 23 to the proximal end 22*a*. The width or thickness of the inlet opening of the pocket 15 is enough to allow insertion of the region from the distal end to the proximal end of the insertion portion 22 (i.e., practically equal to or larger than the maximum width or cross-sectional area of the insertion portion 22).

The pocket 15 is formed of substrate sheets 13*a* and 13*b* overlying each other. In the present embodiment, a pair of substrate sheets 13*a* and 13*b* are joined to make the pocket 15. The counter bumping portion 18 is provided by joints formed inside the pocket 15. As shown in FIG. 3, the counter bumping portion 18 is preferably a portion with a reduced width or thickness in the middle between the inlet opening at one end and the other end of the pocket, for example, a bottleneck. That is, the counter bumping portion 18 is preferably a part with a smaller width or area than the inlet opening of the pocket 15. The bottleneck as the counter bumping portion 18 is configured to be narrow or thin (to have a small area) enough to bump against the bumping portion 23 when the insertion portion 22 is inserted into the pocket 15, so that the bottleneck allows the distal end (22*b*) side region of the insertion portion 22 to pass by with no substantial obstruction but hinders the passage of the proximal end (22*a*) side region. The phrase "with no substantial obstruction" as used herein refers to ease of insertion such that (1) a force necessary to insert does not extremely increase during the insertion so that the insertion is completed without increasing the force or with a virtually constant force, (2) the insertion does not involve distortion or deformation of the insertion portion 22, or (3) the insertion does not need resistance against elastic repulsion of the substrate sheets 13*a* and 13*b* nor stretch of the substrate sheets 13*a* and 13*b*. In the present embodiment, because the width or cross-sectional area of the pocket 15 at the counter bumping portion 18 is almost equal to or larger than that of the distal end (22*b*) side region of the insertion portion 22, there is no substantial interference with inserting the insertion portion 22. Specifically, the distal end (22*b*) side region distal to the bumping portion 23 of the insertion portion 22 is preferably shaped with no projections nor depressions that may catch in the counter bumping portion 18.

Going into detail on the holder 20 of the cleaning implement 1 of the present embodiment, the insertion portion 22 is a flat strip-shaped plate as illustrated in FIGS. 3(*a*) to 3(*c*), 15(*a*), and 15(*b*). The insertion portion 22 is a portion adapted to be inserted into the pocket 15 formed of the two substrate sheets 13*a* and 13*b*. For general domestic use, the insertion portion 22 of the holder 20 preferably has a length of 120 to 200 mm and a width of 20 to 40 mm.

As depicted in FIG. 3(*b*), the insertion portion 22 of the holder 20 has an almost constant width from its proximal end 22*a* to the bumping portion 23, has its width decreased at the bumping portion 23 toward the distal end 22*b*, and has an almost constant width from the bumping portion 23 to the distal end 22*b*. Thus, the insertion portion 22 has its width reduced midway and, in a plan view, substantially symmetrical about the longitudinal centerline.

The corner of each of the shoulders as the bumping portion 23 is rounded as shown in FIGS. 3(*a*) and 3(*b*) so that the insertion portion 22 can be smoothly inserted into and drawn from the pocket 15.

The bumping portion 23 of the insertion portion 22 bumps against the bottleneck as the counter bumping portion 18 of the pocket 15 hereinafter described whereby the insertion portion 22 is prevented from being inserted further into the pocket 15 from the bumping position.

The pair of shoulders (bumping portion 23) on the opposite sides of the insertion portion 22 have the same width W1 (see FIG. 3(*b*)), the width of the part projecting outward from the side edge of the distal end (22*b*) side region. The width W1 of the shoulders (bumping portion 23) is preferably 1 to 10 mm, more preferably 2 to 7 mm. The width W1 of at least 1 mm is preferred to secure bumping between the bumping portion 23 of the holder 20 and the counter bumping portion 18 of the pocket 15 to prevent insertion further into the pocket 15 from the bumping position without fail. The width W1 of 10 mm or smaller is preferred to avoid the holder 20 catching in the inlet opening of the pocket 15 and to secure rigidity of the insertion portion 22 of the holder 20.

The width W2 (see FIG. 3(*b*)) of the region between the bumping portion 23 and the distal end 22*b* of the insertion portion 22 preferably ranges from 50% to 95%, more preferably 70% to 90%, of the width W3 (see FIG. 3(*b*)) of the bumping portion 23 for the same reasons described above.

Going into more detail of the holder 20, the holder 20 has a pair of hooks as a retaining means 24 for catching in the mop 10 (cleaning article) near the proximal end 22*a* of the insertion portion 22. More specifically, the retaining means 24 is provided near the border between the insertion portion 21 and the handle 22. Each of the hooks (retaining means 24) projects obliquely upward toward the handle 21 as illustrated in FIG. 3(*c*). With the insertion portion 22 inserted into the pocket 15, the retaining means 24 catches a cut or a slit as an engaging means of the mop 10 hereinafter described thereby to restrict movement of the mop 10 between the retaining means and the bumping portion 23.

As illustrated in FIG. 3(*c*), the handle 21 and the insertion portion 22 make a prescribed angle in the holder 20. Being so designed, the insertion portion 22 is endowed with flexibility to help the mop 10 conform to a curved or uneven surface of an object being cleaned and achieve increased efficiency of dust removal.

Figure 15A:
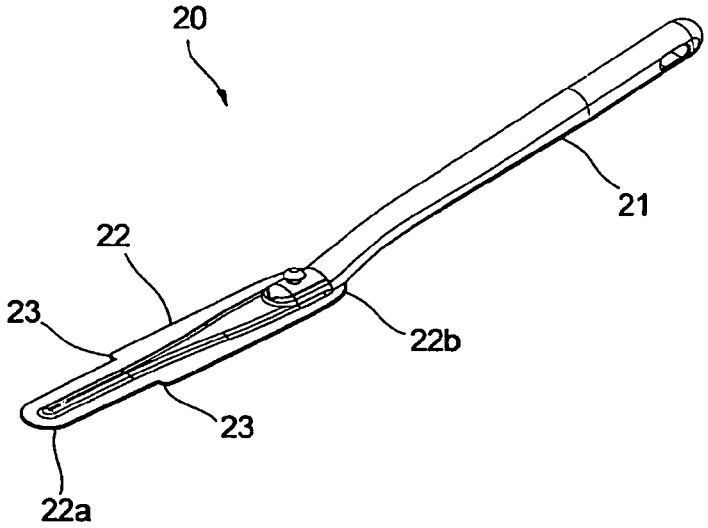
FIG. 15(*a*) illustrates a holder of a cleaning article of a cleaning implement according to still another embodiment of the present invention.
Figure 15B:
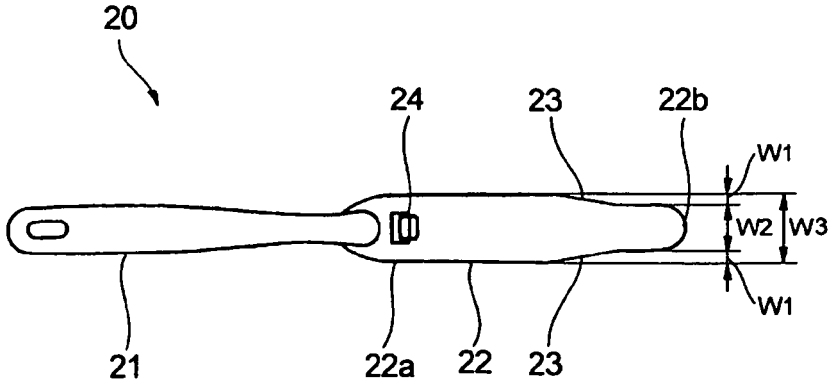

As illustrated in FIG. 3(*b*), the insertion portion 22 can have an elongated rectangular opening in a laterally middle portion thereof. Providing such an opening reduces the rigidity and increases the flexibility of the insertion portion 22. The insertion portion 22 can have its laterally middle portion thickened as illustrated in FIG. 15(*a*). Providing such a thickened portion permits thinning the peripheral portion around the thickened portion. As a result, the insertion portion 22 can exhibit moderate flexibility and have the thinned portion reach into a tight space in a cleaning operation.

The distal end 22*b* of the insertion portion 22 is rounded so as to be inserted into the pocket 15 smoothly.

The bumping portion 23 may be provided at any position between the proximal end 22*a* and the distal end 22*b* of the insertion portion 22. Preferably, it is provided at the middle between the retaining means 24 and the tip of the insertion portion 22 or at a position off the center of the insertion portion 22 to the distal end 22*b*. In the latter configuration, the distance from the bumping portion 23 to the tip is shorter than that from the retaining means 24 to the bumping portion 23. According to the preferred configurations, in the case where combined with the mop 10 having the counter bumping portion 18 in the center of the pocket 15, the tip of the region distal to the bumping portion 23 will be completely hidden in the pocket 15. Hence, the tip of the pocket 15 where the insertion portion 22 is absent softly touches a surface to be cleaned while the tip of the insertion portion 22 is prevented from directly touching the surface being cleaned.

Instead of the shoulder form as adapted in FIGS. 3(*a*) to (*c*) and 15(*a*), the counter bumping portion 18 of the insertion portion 22 may have a form with a continuously decreasing width such as a tapered form as illustrated in FIG. 15(*b*). When such a form is adapted, a part of the form with a decreasing width serves as a counter bumping portion 18. In the particular embodiment shown in FIG. 15(*b*), opposing two points on both sides of the insertion portion 22 serve as a counter bumping portion 18, whereby the mop 10 is held on the insertion portion 22 at three points in total, inclusive of the engagement by the retaining means 24.

In order for the insertion portion 22 to have moderate flexibility, the insertion portion 22 preferably has a flexibility value of 5 to 60 mm, more preferably 20 to 50 mm. A flexibility value of 5 mm or more assures the ability of the insertion portion 22 to apply a mop to an object being cleaned with moderate stiffness. A flexibility value of 60 mm or less assures the ability of the insertion portion 22 to moderately deflect in conformity to the contour of an object being cleaned when applied thereto.

The flexibility value of the insertion portion 22 can be measured, for example, as follows. The basal part of the insertion portion 22 is firmly fixed with the rest overhanging with no support so as to deflect with a load applied. Under that condition, a 200 g weight is suspended from the tip. The deflection of the tip is measured and taken as a flexibility value.

In order for the flexible insertion portion 22 be securely applied to a surface being cleaned, the handle 21 preferably has a rigidity value of 10 mm or less, more preferably 5 mm or less.

The rigidity value of the handle 21 can be measured, for example, as follows. The basal portion of the insertion portion 22 is firmly fixed with the rest overhanging with no support so as to deflect with a load applied. Under that condition, a 300 g weight is suspended from the tip. The deflection of the tip is measured and taken as a rigidity value.

Figure 6:
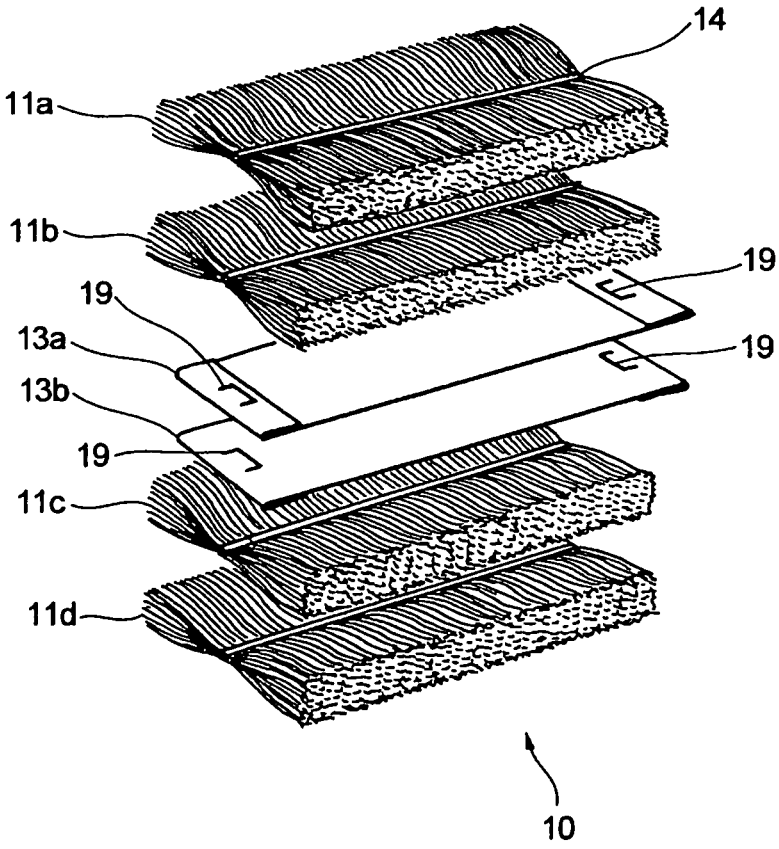
FIG. 6 is a perspective exploded view of the cleaning implement illustrated in FIG. 1.

The mop 10 as a cleaning article in the cleaning implement 1 according to the present embodiment will then be described. The mop 10 has four fiber layers 11*a*, 11*b*, 11*c*, and 11*d* as illustrated in FIG. 6 and exhibits high dust and dirt trapping ability. The mop 10 is formed by stacking a pair of substrate sheets 13*a* and 13*b* and the four fiber layers 11*a* to 11*d* each composed of a fiber bundle.

The mop 10 has two fiber layers both above and below the pair of substrate sheets 13*a* and 13*b*. The fiber bundles of the fiber layers 11*a* to 11*d* are all fuzzed so that the mop 10 assumes a nearly cylindrical shape as a whole as illustrated in FIG. 1. Shaped into a cylinder, the mop 10 gains in area of a region encircled by the perimeter defined by the fiber tips of the fiber bundles. That is, the mop 10 exhibits increased dust trapping ability owing to the increased dust trapping area defined by the fiber tips. The fiber bundles of the fiber layers 11*a* to 11*d* can be fuzzed by, for example, blowing air to the fiber layers.

As illustrated in FIGS. 4 and 6, each of the substrate sheets 13*a* and 13*b* of the mop 10 is an oblong rectangle with its longitudinal direction coinciding with the longitudinal direction of the mop 10. The mop 10 of the present embodiment has one pocket 15. The pocket 15 is formed by joining the pair of substrate sheets 13*a* and 13*b* in two joining zones 16*a* and 16*b* extending in the direction of inserting the holder 20. The two joining zones 16*a* and 16*b* are spaced apart from each other in a direction perpendicular to the direction of inserting the holder 20. As shown in FIG. 4, the joining zones 16*a* and 16*b* are spaced apart from each other in the lateral direction of the substrate sheets 13*a* and 13*b* and each extend in the longitudinal direction of the substrates sheets 13*a* and 13*b* with a small width (the zones delineated by the dotted lines in FIG. 4).

Each of the joining zones 16*a* and 16*b* of the pocket 15 is a line of joints 17 spacedly aligned in the direction of inserting the holder 20. That is, the joints 17 are spacedly aligned between a pair of imaginary lines practically parallel to each other and extending from one end to the other end of the substrate sheets 13*a* and 13*b*. In more detail, the individual joints 17 are elliptic in a plan view with the major axis coinciding with the longitudinal direction of the substrate sheets 13*a* and 13*b*. The joints 17 are formed by known joining means, such as fusion bonding by heat sealing or adhesion with an adhesive. In the cases where the substrate sheets 13*a* and 13*b* are made out of a heat fusible material, the joints 17 are easily and conveniently formed by thermal bonding. The pocket 15 is thus formed by joining the substrate sheets 13*a* and 13*b* overlying each other by the joints 17 spacedly aligned in the direction of inserting the insertion portion 22 of the holder 20.

It is preferred that the two substrate sheets 13*a* and 13*b* not be joined to each other between every adjacent joints 17 in each of the joining zones 16*a* and 16*b*. When the joining zones 16*a* and 16*b* are each formed of discrete joints 17, the substrate sheets 13*a* and 13*b* have improved flexibility in their longitudinal direction and are easily conformed to the contour of an object being cleaned. As a result, the fiber layers joined to each of the substrate sheets 13*a* and 13*b* are also easily conformed to the contour of an object being cleaned to produce improved dust and dirt trapping effects of the mop 10.

Figure 5:
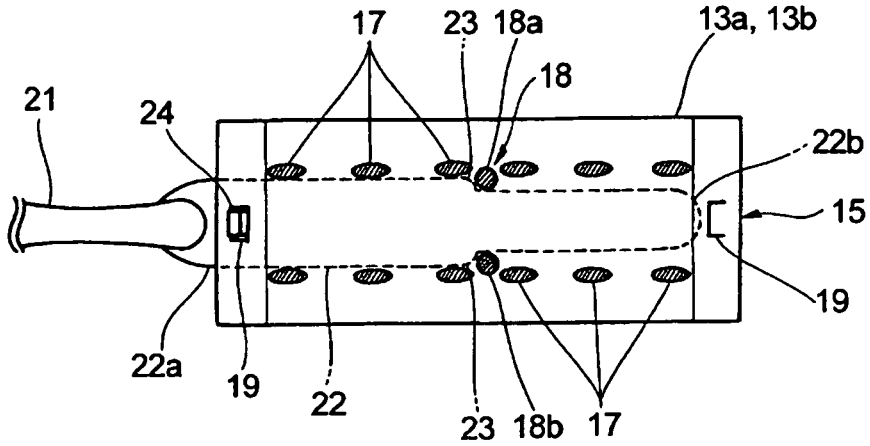
FIG. 5 is a plan view of the pair of substrate sheets of FIG. 4 having a holder inserted therebetween.

With the holder 20 inserted in the pocket 15, the side edges of the region of the insertion portion 22 distal to the counter bumping portion 18 are away from the joining zones 16*a* and 16*b* as illustrated in FIG. 5.

Therefore, the region of the mop 10 distal to the counter bumping portion 18 has improved flexibility in the lateral direction. When a user moves the holder 20 along the surface of an object to be cleaned, the mop 10 flexibly moves along the contour of an object to be cleaned so that the distal end portion of the mop 10 exhibits enhanced dust and dirt trapping effects.

The interval of the joints 17 aligned in the longitudinal direction in each joining zone 16*a* or 16*b* is preferably 10 to 30 mm, more preferably 15 to 25 mm, to produce the effects described.

The joining zones 16*a* and 16*b* of the pocket 15 are spaced apart in the lateral direction of the pair of substrate sheets 13*a* and 13*b*. The width of the space between them is almost the same or slightly larger than the width W3 of the region of the insertion portion 22 from the proximal end 22*a* and the bumping portion 23. The width of the inlet opening of the pocket 15 corresponds to the width of the space between the joining zones 16*a* and 16*b*. As long as the relation of the width of that space (almost equal to W3) to the width W2 of the distal end 22*b* of the insertion portion 22 falls within the above-recited range, the insertion portion 22 can be inserted into the pocket 15 without catching in the inlet opening even when inserted slightly at an angle relative to the pocket. The holder 20 can thus be easily inserted in and drawn from the pocket 15.

With the holder 20 in the pocket 15 as illustrated in FIG. 5, the joining zones 16*a* and 16*b* are in partial contact with the lateral side edges of the insertion portion 22 to thereby restrict movement of the insertion portion 22 in the lateral direction of the pair of substrate sheets 13*a* and 13*b*.

Before the mop 10 is attached to the holder 20, namely before use, the pocket 15 having the above-described structure is the pair of substrate sheets 13*a* and 13*b* overlying and contacting each other as illustrated in FIG. 4. On inserting the holder 20 therein, the substrate sheets 13*a* and 13*b* are separated apart to form a flattened tubular space.

The pocket 15 of the mop 10 has an inlet opening at each end thereof in the direction of inserting the holder 20. The holder can be inserted into the pocket 15 in whichever direction to cause the bumping portion 23 to bump against the counter bumping portion 18, and the retaining means 24 provided on the holder 20 retains the vicinity of the inlet opening of the mop 10.

Going into more detail, the pocket 15 spans the two longitudinal ends of the substrate sheets 13*a* and 13*b*. The pocket 15 has an inlet opening at each longitudinal end of the substrate sheets 13*a* and 13*b* so that the holder 20 may be inserted from whichever inlet opening.

Each of the paired substrate sheets 13*a* and 13*b* is folded back outward at its both longitudinal ends to make the end portions stiffer and easier to grasp with fingertips as illustrated in FIGS. 4 and 6. As a result, the maneuverability in inserting or removing the holder into or from the mop 10 can be improved.

The position of providing the counter bumping portion 18 in the pocket 15 of the mop 10 is the center of the pocket 15 in the direction of inserting the holder 20 as illustrated in FIG. 4. In the present embodiment, the counter bumping portion 18 includes a pair of bumping joints 18*a* and 18*b* spaced apart in the direction perpendicular to the direction of inserting the holder 20.

Each of the paired bumping joints 18*a* and 18*b* is circular in a plan view and formed by known joining means such as fusion (e.g., heat sealing) or adhesion with an adhesive. In the case when the substrate sheets 13*a* and 13*b* are made out of heat fusible material, the bumping joints 18*a* and 18*b* are conveniently and preferably formed by heat fusion.

The pair of bumping joints 18*a* and 18*b* are spaced apart in the lateral direction of the pocket 15. The space between them is almost equal to or slightly wider than the width W2 of the region of the insertion portion 22 from the bumping portion 23 to the distal end 22*b*.

As illustrated in FIG. 5, the paired bumping joints 18*a* and 18*b* allow the insertion portion 22 of the holder 20 to be inserted smoothly until the bumping portion 23 bumps thereagainst and, after the bumping, prevent the region of the insertion portion 22 behind the bumping portion 23 from proceeding ahead the bumping joints 18*a* and 18*b*, i.e., prevent further insertion into the pocket 15. After the holder 20 is inserted into the pocket 15 to hold the mop 10, the distal end

22*b* of the insertion portion 22 is located near the opposite end of the pocket 15 to the inlet opening through which the holder has entered. It is preferred that the distal end 22*b* not stick out of the opposite end of the pocket 15.

Figure 2:
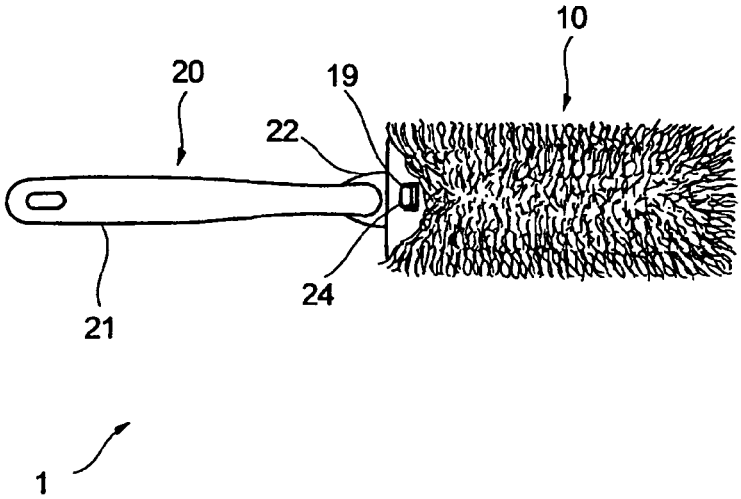
FIG. 2 is a plan view of the cleaning implement of FIG. 1.

The mop 10 used in the present embodiment has an engaging means 19 that engages with the retaining means 24. The engaging means 19 is provided near the inlet opening of the mop 10. In detail, each of the paired substrate sheets 13*a* and 13*b* has a cut as an engaging means 19 that engages with the hook as a retaining means 24 of the holder 20 at both longitudinal (in the direction of inserting the holder 20) ends thereof as illustrated in FIGS. 2 and 5.

The cut (engaging means 19) may have various shapes such as a straight slit, a punched hole, and a curved slit. The cut formed in the present embodiment is an angular U-shaped slit. The flap portion of the substrate sheet 13*a* or 13*b* created by the U-shape cutting is capable of opening upward and outward with respect to the longitudinal direction of the sheet 13*a* or 13*b*. On engaging the engaging means 19 with the retaining means 24, the holder 20 is restricted from moving in the longitudinal direction in the pocket 15, particularly in the unsheathing direction. The mop 10 is thus stably held by the holder 20.

With the hook (retaining means 24) being in an engagement relation with the cut (engaging means 19), it is preferred that the hook 24 be in intimate contact with the cut 19 or loose contact with the cut 19 with a predetermined allowance. Where the hook 24 and the cut 19 are engaged into intimate contact, the mop 10 moves little between the bumping portion 23 and the retaining means 24.

Since the engaging means 19 is provided in both the substrate sheets 13*a* and 13*b*, the mop 10 can be attached to the holder 20 with whichever side of the pocket 15 up.

As described, the cleaning implement 1 according to the present embodiment is oblong as a whole and includes a mop 10 having a flattened tubular pocket 15 and a holder 20 adapted to be inserted into the pocket 15. As illustrated in FIG. 4, the pocket 15 is formed by joining a pair of substrate sheets 13*a* and 13*b*. As shown in FIGS. 3(*a*) to (*c*), the holder 20 includes a handle 21 and a platy insertion portion 22 extending from the tip of the handle 21 and adapted to be inserted into the pocket 15. The insertion portion 22 has a pair of shoulders 23 as a bumping portion provided in the middle between the proximal end 22*a* and the distal end 22*b* thereof. The region of the insertion portion 22 from the shoulders 23 to the distal end 22*b* is narrower than the region from the shoulders 23 to the proximal end 22*a*. The width of the inlet opening of the pocket 15 is larger than the width of the distal end 22*b* and is almost equal to the width of the region of the insertion portion 22 between the shoulders 23 and the proximal end 22*a*. The pocket 15 is formed by joining a pair of substrate sheets 13*a* and 13*b* in two joining zones 16*a* and 16*b* each extending in the direction of inserting the holder 20. The two joining zones 16*a* and 16*b* are spaced apart from each other in a direction perpendicular to the direction of inserting the holder 20. As shown in FIG. 5, the pocket 15 has a bottleneck 18 as a counter bumping portion the width of which is smaller than the width of the region of the insertion portion 22 from the shoulders 23 to the proximal end 22*a*. In the present embodiment, the direction of inserting the holder 20 coincides with the longitudinal direction of the mop 10, and the direction perpendicular to the holder inserting direction coincides with the lateral direction of the mop 10.

The mop 10 is attached to the holder 20 to complete the cleaning implement 1 of the present embodiment, for example, in the following manner. The insertion portion 22 is inserted into the pocket 15 until the bumping portion 23 bumps against the counter bumping portion 18 to restrict further insertion. The end of the mop by the inlet opening of the pocket 15 is grasped and pulled obliquely upward toward the handle 21 to engage the cut as an engaging means 19 with the retaining means 24 whereby the mop 10 is held by the holder 20.

The mop 10 can be detached from the holder 20, for example, as follows. The end by the inlet opening of the pocket 15 is grasped and pulled obliquely upward toward the handle 21 to disengage the cut as an engaging means 19 from the retaining means 24. The holder 20 is then drawn from the pocket 15 and removed from the mop 10.

To go into still more detail of the mop 10, the fiber layers 11*a*, 11*b*, 11*c*, and 11*d* are fiber bundles having a prescribed thickness oriented in the same direction. The fiber bundles are oriented in the lateral direction of the mop 10 as illustrated in FIG. 6.

The fiber layers 11*a* and 11*b* are superposed on the substrate sheet 13*a* with the fiber orientation direction of the fiber layers 11*a* and 11*b* being in a substantially perpendicular relation to the substrate sheet 13*a*. The fiber layers 11*a* and 11*b* and the substrate sheet 13*a* are joined together with aligned longitudinal centerlines. Joining is done along a straight linear joint 14 having a prescribed width. The linear joint 14 is formed on the aligned longitudinal centerlines of the fiber layers 11*a* and 11*b* and the substrate sheet 13*a* by a known joining means, such as fusion bonding (e.g., heat sealing) or adhesion with an adhesive. In the cases where the fiber layers 11*a* and 11*b* and the substrate sheet 13*a* are all made out of heat fusible material, the linear joint 14 is conveniently formed by thermal bonding.

The fiber layers 11*c* and 11*d* and the substrate sheet 13*b* are superposed and joined together in the same manner as described above. The paired substrate sheets 13*a* and 13*b* are not joined by the linear joint 14.

It is preferred that the fiber layer 11*b*, the substrate sheet 13*a*, the substrate sheet 13*b*, and the fiber layer 11*c* be joined together at the joints 17 in the joining zones 16*a* and 16*b* and the pair of bumping joints 18*a* and 18*b* by fusion bonding to impart stiffness to the mop 10 while retaining the flexibility of the mop 10.

The assembly thus constructed is then processed to fuzz up the fiber layers into a cylindrical shape to provide the mop 10 of the present embodiment.

The members constituting the mop 10 of the present embodiment will be described.

The fibers constituting the fiber layers 11*a* to 11*d* preferably have a length of 30 to 150 mm, more preferably 50 to 100 mm, in view of dust trapping capabilities. In the present embodiment, fibers having such a length are used in the form of a fiber bundle (tow). It is preferred that the tow be sufficiently split with a known tow splitting device beforehand.

It is particularly preferred to use crimped fibers to obtain further improved dust trapping capabilities. Two-dimensionally or three-dimensionally crimped fibers can be used. The percentage of crimp (JIS L0208) is preferably 5% to 50%, more preferably 10% to 30%, to obtain improved dust trapping capabilities. The percentage of crimp is defined to be a percentage of a difference between the length A of a crimped fiber in its straightened state and the natural length B of the crimped fiber to the length A, being calculated from equation:

$$\text{Percentage of crimp (\%)}=(A-B)/A\times 100$$

The natural length B is the length of the straight line connecting the two ends of a crimped fiber in its natural state. The term "natural state" means a state of a crimped fiber hanging under its own weight with its one end fixed to a horizontal plate. The term "length A in a straightened state" means the length of a crimped fiber stretched out until no crimp remains under a minimum load.

The percentage of crimp falling within the range recited above, the number of crimps is preferably 2 to 10 per centimeter. The number of crimps is measured in accordance with JIS L1015 8.12.1.

While the thickness of the fibers is not particularly limited, it is preferred to use fibers having a thickness of 0.1 to 200 dtex, preferably 2 to 30 dtex, to secure dust trapping capabilities and prevent scratches on a surface being cleaned.

The material forming the substrate sheets 13*a* and 13*b* for use in the mop 10 can be any of fibrous sheets such as nonwovens historically employed in conventional cleaning articles. Air-through nonwovens and spun-bonded nonwovens are particularly preferred.

Thermoplastic resins are preferably used to make the holder 10. Examples of thermoplastic resins preferred from the standpoint of securing moldability and flexibility include polyethylene, polypropylene, polyvinyl chloride, polystyrene, ABS resin, and acrylic resins.

According to the present embodiment, the insertion portion 22 of the holder 20 has its distal portion narrowed and is therefore easy to insert into and draw from the pocket 15. The inserted insertion portion 22 is restricted from moving in the longitudinal direction in the pocket 15. At the same time, the engaging means 19 engages with the retaining means 24. The mop 10 is thus held on the holder 20 in a stable manner. The mop 10 is hardly detached from the holder 20 during use and is easily detached from the holder 20 as stated supra.

Since the holder can be inserted from whichever end of the mop 10, there is the advantage that the mop 10 having its one longitudinal end portion soiled as a result of cleaning operation can be once detached from the holder 20, and the holder 20 is re-inserted into the pocket 15 from the other inlet opening to provide the less soiled opposite end portion to continue cleaning.

The cleaning implements incorporating the second to fourth embodiment of the present invention are now illustrated with reference to FIGS. 7 through 12.

The description on the first embodiment applies to the second to fourth embodiments described hereunder unless otherwise specified. Members common to both FIGS. 1 to 6 and FIGS. 7 to 12 are given the same numerical an/or alphabetical designations.

Figure 7:
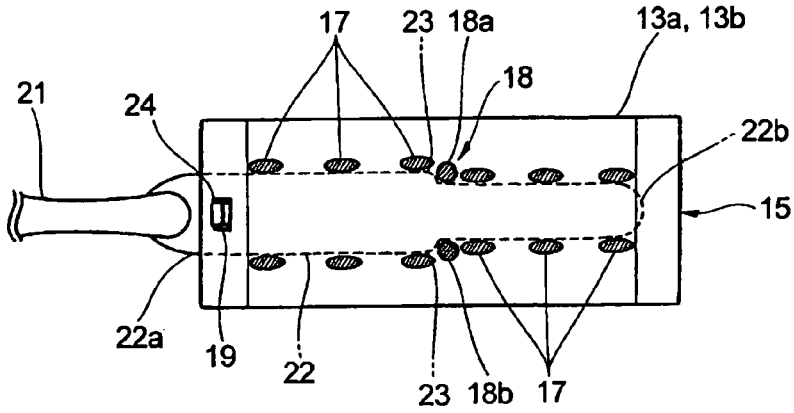
FIG. 7 is a plan view of a pair of substrate sheets of a cleaning article used in a cleaning implement according to a second embodiment of the present invention, between which a holder is inserted.

The cleaning implement 1 according to the second preferred embodiment of the invention is designed so that the holder 20 is insertable from only one of the longitudinal ends of the pocket 15 of the mop 10 as illustrated in FIG. 7. Accordingly the cut as an engaging means 19 is provided on only the side of the inlet opening through which the holder is inserted.

In the present embodiment, the width between the joining zones 16*a* and 16*b* of the pocket 15 is different between the region on the inlet opening side (where the engaging means 19 is provided) of the pair of bumping joints 18*a* and 18*b* and the region on the opposite side. The width between the joining zones 16*a* and 16*b* in the region on the engaging means (19) side is almost equal to or slightly larger than the width W3 (see FIG. 3(*b*)) of the insertion portion 22 from the proximal end 22*a* up to the bumping portion 23.

On the other hand, the width between the joining zones 16*a* and 16*b* in the region having no engaging means 19 is almost equal to or slightly larger than the width W2 (see FIG. 3(*b*)), the maximum width of the insertion portion 22 from the bumping portion 23 to the distal end 22*b*.

As illustrated in FIG. 7, with the holder 20 having been inserted into the pocket 15 until the bumping portion 23 of the insertion portion 22 bumps against the counter bumping portion 18 of the pocket 15, the joining zones 16*a* and 16*b* are in partial contact with almost the whole length of the respective lateral side edges of the insertion portion 22. Therefore, the insertion portion 22 is prevented from moving in the lateral direction of the paired substrate sheets 13*a* and 13*b*.

The cleaning implement of the second embodiment is otherwise structurally the same as the one according to the first embodiment.

According to the second embodiment, lateral movement of the insertion portion 22 in the pocket 15 is further restricted so that the mop 10 is held on the holder 20 more stably. Understandably, the second embodiment achieves the same effects as by the first embodiment.

In the first embodiment the counter bumping portion 18 is defined by the bumping joints 18*a* and 18*b*. In the second embodiment, the counter bumping portion 18 is formed by providing a pair of bumping joints 18*a* and 18*b* to make a difference in width or cross-sectional area of the space between the joining zones 16*a* and 16*b* such that the space on the inlet opening side is wider than the space on the opposite side. The configuration of the counter bumping portion 18 is not limited thereto. Various configurations can be taken as long as the counter bumping portion 18 bumps against the bumping portion 22 of the insertion portion 22 being inserted into the pocket 15 of the mop 10 thereby to restrict further insertion of the insertion portion 22 from the bumping position. In another example of such a configuration, the pocket 15 is designed to have a larger width (or cross-sectional area) than the maximum width (or cross-sectional area) of the insertion portion 22 at the inlet opening thereof and to have a tapered region in the middle. The tapered region is provided between the inlet opening and the tip of the pocket 15. In the tapered region the width between the joining zones 16*a* and 16*b* is gradually decreased toward the tip. The tapered region has its width decreased to such a width that causes bumping to the bumping portion 23 (preferably in the form of shoulders) of the insertion portion 22 but wide enough to allow the region of the insertion portion 22 between the bumping portion 23 and the distal end 22*b* to pass through. In that configuration, the insertion portion 22 is allowed to proceed smoothly while being guided by the tapered region until the bumping portion 23 bumps against the counter bumping portion 18.

Figure 8A:
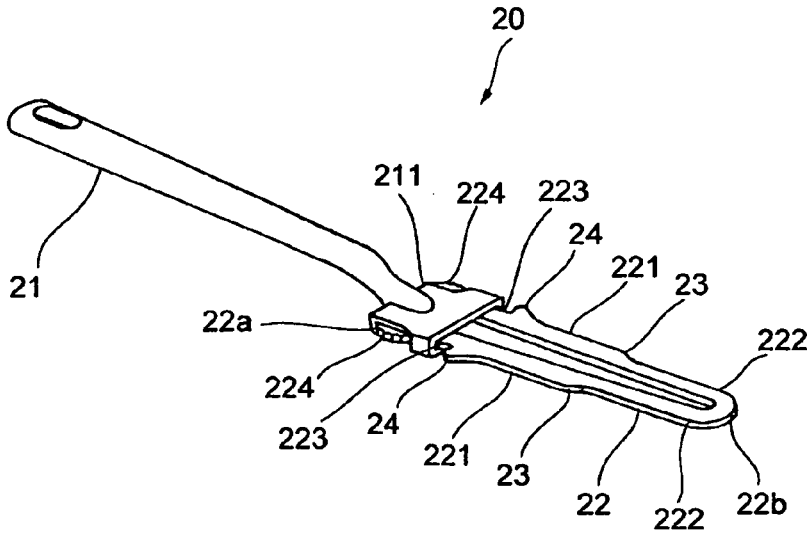
FIG. 8(*a*) is a perspective view of a holder used in a cleaning implement according to a third embodiment of the present invention.
Figure 8B:
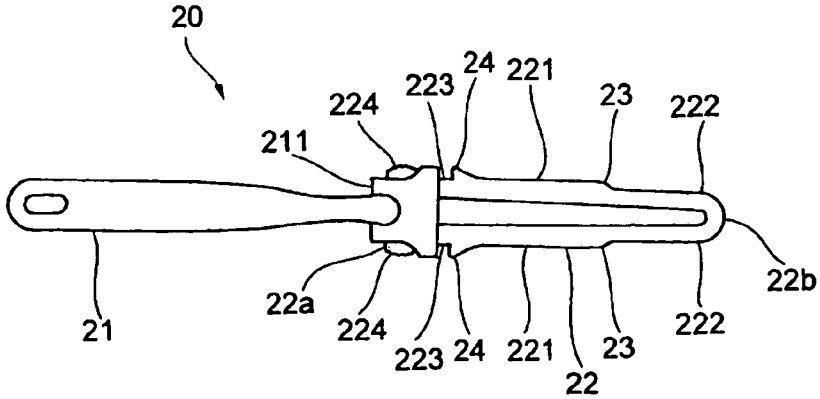
Figure 8C:
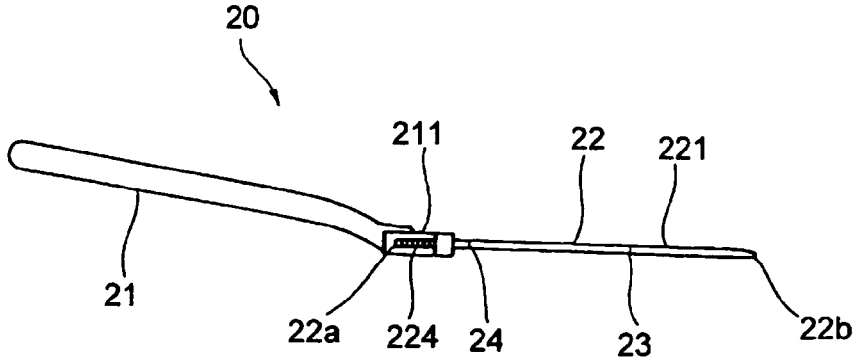
Figure 9:
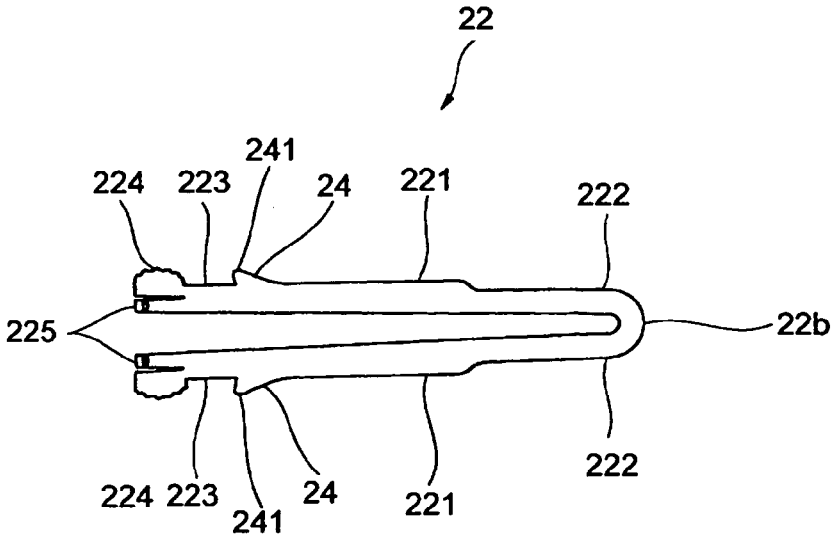
FIG. 9 is a plan view of the insertion portion of the holder illustrated in FIG. 8.

In the third preferred embodiment of the cleaning implement 1, the insertion portion 22 has a pair of flat sticks 221 extending practically parallel to each other as illustrated in FIGS. 8 and 9. The paired flat sticks 221 are spaced apart in the direction perpendicular to their longitudinal direction. The paired flat sticks 221 are connected to each other at their tips 222. The insertion portion 22 has a pair of hooks as a retaining means 24 on the outer edges thereof near the bases 223 of the respective flat sticks 221. The distance between the respective tips 241 of the paired hooks is larger than the width of the inlet opening of the pocket 15. The paired flat sticks 221 are deflectable to narrow the gap between the respective bases 223.

The insertion portion 22 used in the third embodiment is made of an elastic thermoplastic resin. The insertion portion 22 has a pair of actuating portions 224 on the outer edge of the free end (i.e., handle-sided end) of each of the flat sticks near the bases 223 of the flat sticks 221 as illustrated in FIGS. 8 and 9. On pushing the pair of actuating portions 224 inboard to bring them closer, the gap between the bases 223 of the flat sticks 221 is narrowed. Because the pair of flat sticks 221 are cantilevers connected at their tips 222, they exhibit restoring force to restore the original gap therebetween when deflected to bring their bases 223 closer to or farther away from each other.

Figure 10:
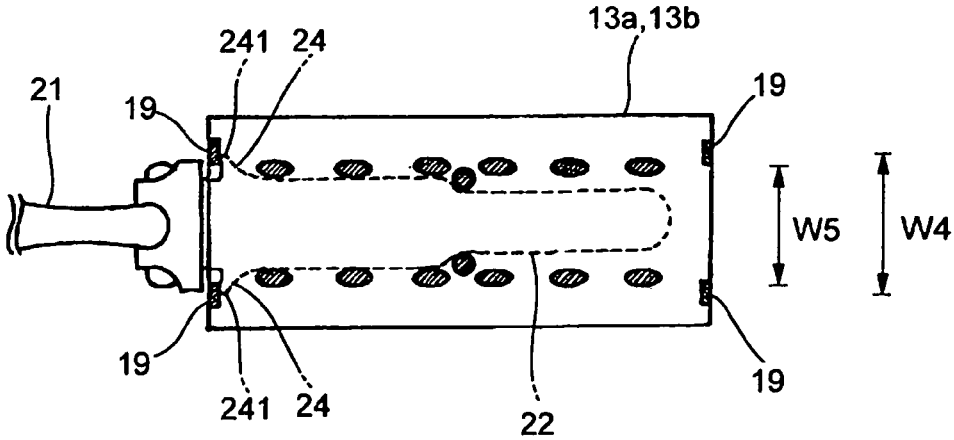
FIG. 10 is a plan view of a pair of substrate sheets having the holder of FIG. 8 inserted therebetween.

To go into more detail of the cleaning implement 1 of the third embodiment, the engaging means of the mop is a pair of engaging joints 19 spaced apart in the direction perpendicular to the direction of inserting the holder 20 as illustrated in FIG. 10.

As shown in FIG. 10, the holder 20 has its insertion portion 22 inserted into the pocket 15 of the mop 10 and makes the pair of hooks (retaining means 24) catch in the pair of engaging joints 19 to thereby hold the mop 10.

Each of the engaging joints 19 is formed by partly joining the substrate sheets 13*a* and 13*b* at both longitudinal ends. The individual joints 19 are oblong rectangles with their longitudinal direction coinciding with the lateral direction of the substrate sheets 13*a* and 13*b*.

The engaging joints 19 are formed by a known joining means such as heat sealing or adhesion with an adhesive. In the case where the substrate sheets 13*a* and 13*b* are both made of a heat fusible material, it is convenient and preferred to form the joints 19 by thermal bonding.

As illustrated in FIG. 10, the pair of the engaging joints 19 are spaced apart the width W5 (see FIG. 10) in the lateral direction of the paired substrate sheets 13*a* and 13*b*. To secure ease of insertion and removal of the insertion portion 22 into and from the pocket 15, the width W5 is preferably larger than the width W3 (the width of the region of the insertion portion 22 between the pair of hooks as the retaining means 24 and the bumping portion 23) by at least 1 mm, more preferably 3 mm or more.

The holder 20 has the insertion portion 22 detachably fitted into the handle 21. The handle 21 has a female member 211 at the tip thereof, into which the proximal end 22*a* of the insertion portion 22 is snap fitted. The female member 211 has a window on each side. With the proximal end 22*a* snap-fitted into the female member 211, the pair of the actuating portions 224 located at the proximal end of the insertion portion 22 protrude outward from the windows of the female member 211 as illustrated in FIGS. 8(*a*) and 8(*b*).

The retaining means 24 is wedge-shaped as shown in FIG. 9 so that the insertion portion 22 may smoothly be guided into the pocket 15. The retaining means 24 on the side edge of the base 223 projects laterally outward from the side edge of the flat stick 221 and slightly obliquely toward the edge of the base 223 so that it is hardly disentangled from the engaging joint 19.

With the insertion portion 22 being in a disassembled state from the handle 21 as in FIG. 9, the insertion portion 22 has a nearly constant width from the pair of hooks as the retaining means 24 to the bumping portion 23 and changes its width at the bumping portion 23 to have a smaller, nearly constant width from the bumping portion 23 to the distal end 22*b*. Thus, the insertion portion 22 has its width reduced midway and, in a plan view, substantially symmetrical about the longitudinal centerline. As can be seen from FIGS. 8(*a*) to (*c*), the overall appearance of the holder 20 is almost the same as that of the foregoing embodiments.

FIG. 9 is a plan view of the insertion portion 22 in a detached state from the handle 21. In this state, the gap between the bases 223 of the paired flat sticks 221 of the insertion portion 22 is wider than that in the fitted state into the female member 211 of the handle 21 (see FIG. 8). Accordingly, the pair of the bases 223 exhibits restoring force to broaden the gap therebetween, i.e., to separate apart from each other within the female member 211. The bases 223 are stably fixed in the female member 211 by this force. Each of the paired actuating portions 224 has an auxiliary fixing portion 225 on the inner side thereof as illustrated in FIG. 9. The pair of flat sticks 221 are thus fixed and restricted from planar movement by the auxiliary fixing portions 225.

With the insertion portion 22 being in the fitted state into the handle 21 as illustrated in FIG. 10, it is preferred that the width W4 (see FIG. 10) of the insertion portion at the tips 241 of the hooks as the retaining means 24 be larger than the width W5 between the paired engaging joints 19 by at least 1 mm, more preferably 3 mm or more.

When the width W4 is larger than the width W5 by at least 1 mm, preferably 3 mm or more, the pair of hooks as the retaining means 24 are engaged with the engaging joints 19 without fail. The upper limit of the width W4 is preferably decided as appropriate based on the dimensions of, e.g., the insertion portion 22 or the substrate sheets 13.

Figure 11:
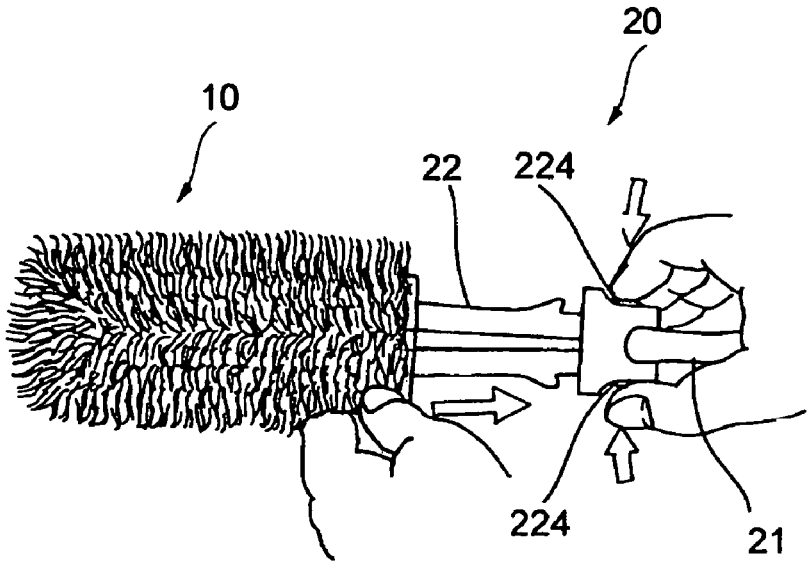
FIG. 11 schematically illustrates the insertion portion of the holder of FIG. 8 being inserted into a pocket of a cleaning article.

As illustrated in FIG. 11, on pushing the pair of actuating portions 224 inboard to bring them closer, the width W4 between the tips 241 of the retaining means 24 (paired hooks) becomes smaller than the width W5 between the engaging joints 19. On stopping pushing the actuating portions 224 inboard, the gap between the bases 223 of the paired flat sticks 221 widens due to the restoring force of the insertion portion 22. That is, the width W4 between the tips 241 of retaining means 24 (paired hooks) becomes larger than the width W5 between the engaging joints 19. In that state, each of the hooks as the retaining means 24 gets engaged with the engaging joint 19 as illustrated in FIG. 10. Thus, the holder 20 is restricted from moving longitudinally outward in the pocket 15 and stably fixed to the mop 10.

The load required to push the pair of actuating portions 224 inboard to make the width W4 smaller than the width W5 as described above is preferably 0.1 to 5 N, more preferably 0.5 to 3 N. To set that load at 0.1 N or more prevents the pair of actuating portions 224 from being pushed inboard by mistake and detaching the mop 10 from the holder 20 during a cleaning operation. To set that load at 5 N or less allows people of all ages to push the pair of actuating portions 224 inboard to attach and detach the mop 10 to and from the holder 20.

The above-described load can be measured, for example, as follows. The actuating portions of the implement is set on a compression tester, and the load is measured when the actuating portions are pushed inboard to the deepest.

The cleaning implement 1 of the third embodiment is otherwise structurally the same as that of the first embodiment.

The mop 10 is attached to the holder 20 to provide the cleaning implement 1 of the third embodiment, for example, as follows. As illustrated in FIG. 11, the pair of actuating portions 224 are pushed inboard to make the width W4 smaller than the width W5. In this state, the insertion portion 22 is inserted into the pocket 15. When the bumping portion 23 bumps against the bottleneck (counter bumping portion 18), and further insertion is restricted, pushing the actuating portions 224 is stopped. Thereupon, the gap between the bases 223 of the flat sticks 221 widens by the restoring force of the insertion portion 22. As a result, the hooks (retaining means 24) engage with the engaging joints 19 as illustrated in FIG. 10, whereby the mop 10 is firmly attached to the holder 20.

Figure 12:
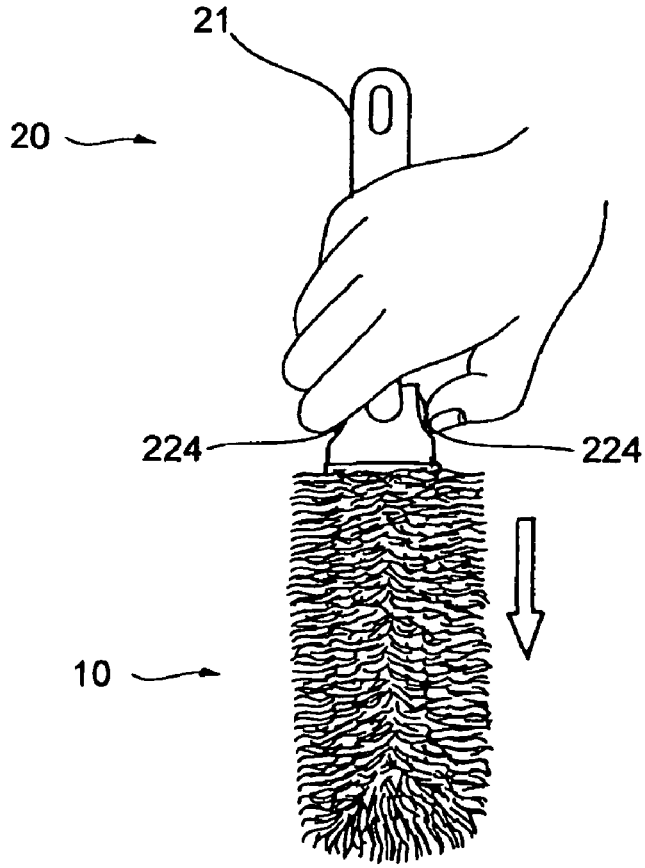
FIG. 12 schematically illustrates a cleaning article being detached from the insertion portion of the holder of FIG. 8.

Conversely, the mop 10 is detached from the holder 20, for example, as follows. As illustrated in FIG. 12, the handle 21 is gripped in one hand with the mop 10 down. In this state, the pair of actuating portions 224 are pushed inboard to make the width W4 smaller than the width W5, whereby the mop 10 comes off the pocket 15 by its own weight and thus removed from the holder 20.

The cleaning implement of the third embodiment is advantageous in that attachment and detachment of the mop 10 to and from the holder 20 are easier and that a user can dispose of the soiled mop 10 without touching with his or her hand. Understandably, the third embodiment achieves the same effects as by the first embodiment.

A cleaning implement 1 according to the fourth preferred embodiment of the present invention includes a mop 10 having a tubular pocket 15 and a holder 20 adapted to be inserted into the pocket to hold the mop 10.

In cleaning implement 1 of the present embodiment, the pocket 15 is formed by joining a pair of substrate sheets 13*a* and 13*b*, and the holder 20 includes a handle 21 and an insertion portion 22 that extends from the tip of the handle 21 and is adapted to be inserted into the pocket 15. The insertion portion 22 has a bumping portion 23 in the middle between its proximal end 22*a* and its distal end 22*b*. The region of the insertion portion 22 between the bumping portion 23 and the distal end 22*b* is smaller in thickness than the region proximal to the bumping portion 23. The size of the inlet opening of the pocket 15 is larger than the thickness of the distal end 22*b* and almost equal to the thickness of the region proximal to the bumping portion 23. The pocket 15 is formed by joining a pair of substrate sheets 13*a* and 13*b* in joining zones 16*a* and 16*b* extending in the direction of inserting the holder 20. The two joining zones 16*a* and 16*b* are spaced apart in the direction perpendicular to the direction of inserting the holder 20. Each joining zone 16*a* or 16*b* consists of joints 17 spacedly arranged in the direction of inserting the holder 20. The pocket 15 has a bottleneck as a counter bumping portion 18 the thickness of which corresponds to that of the region of the insertion portion 22 distal to the shoulders (bumping portion 23).

Going into the detail of the holder 20 of the cleaning implement 1 according to the fourth embodiment, the insertion portion 22 has an elongated shape, the transverse cross-section of which is circular. The insertion portion 22 is inserted into the pocket 15 formed of two substrate sheets 13*a* and 13*b*.

The insertion portion 22 has an almost constant thickness between its proximal end 22*a* and the bumping portion 23, has its thickness changed at the bumping portion 23 to have a smaller thickness in the region distal to the bumping portion 23, and has an almost constant thickness between the bumping portion 23 and the distal end 22*b*. In the present invention, the term "thickness" as used with respect to the insertion portion 22 means a cross-sectional area taken in a direction perpendicular to the longitudinal direction of the insertion portion 22.

The proximal, cylindrical region of the insertion portion 22 from the proximal end 22*a* up to the shoulders 23 continues to the distal, cylindrical region from the bumping portion 23 to the distal end 22*b* with their axes aligned.

The thickness (cross-sectional area) of the region between the bumping portion 23 and the distal end 22*b* of the insertion portion 22 preferably ranges from 50% to 95%, more preferably 70% to 90%, of that of the region between the proximal end 22*a* and the bumping portion 23. Within the recited range, the bumping portion 23 securely bumps against the counter bumping portion 18 to prevent further insertion into the pocket 15 without fail, the holder 20 can be inserted without catching in the inlet opening of the pocket 15, and the rigidity of the insertion portion 22 of the holder 20 can be secured.

The bumping portion 23 is tapered toward the distal end 22*b* to help the holder 20 proceed into the pocket 15 smoothly.

As described, the insertion portion 22 has a thinned, distal region. The cleaning implement of the fourth embodiment is otherwise structurally the same as in the first embodiment.

The mop 10 used in the cleaning implement 1 of the fourth embodiment will further be described in more detail. The position of providing the counter bumping portion 18 in the pocket 15 of the mop 10 is the center of the pocket 15 in the direction of inserting the holder 20. In the present embodiment, the counter bumping portion 18 includes a pair of bumping joints 18*a* and 18*b* spaced apart in the direction perpendicular to the direction of inserting the holder 20. Each of the paired bumping joints 18*a* and 18*b* is circular in a plan view.

On inserting the insertion portion 22 of the holder 20 in the pocket 15, the paired substrate sheets 13*a* and 13*b* are separated apart to form a tubular space having a circular cross-section. After the insertion portion 22 bumps at its bumping portion 23 against the counter bumping portion 18, further insertion of the insertion portion 22 into the pocket 15 is restricted.

According to the fourth embodiment of the cleaning implement 1, the holder 20 has an increased rigidity in the insertion portion 22 thereof. This facilitates rubbing off tough dust and dirt from a surface to be cleaned. It is understandable that the fourth embodiment achieves the same effects as by the first embodiment.

The cleaning implement 1 of the present invention is not limited to the foregoing embodiments, and various changes and modifications can be made therein without departing from the spirit and scope of the invention.

Figure 13:
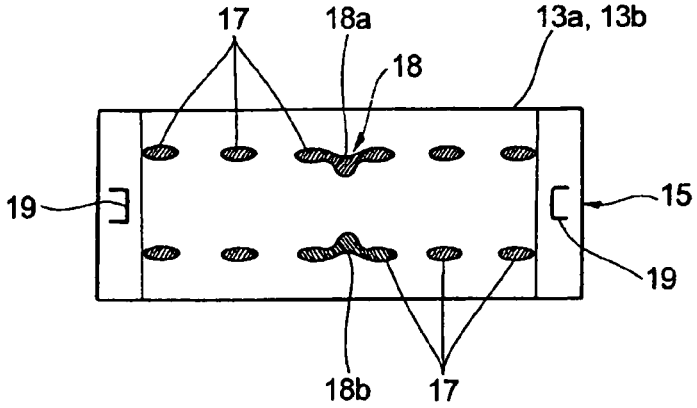
FIG. 13 is a plan view of a bottleneck of a cleaning article of a cleaning implement according to another embodiment of the present invention.

For example, while in the foregoing embodiments the joining zones 16*a* and 16*b* are formed by discretely aligned joints 17, they may be formed by continuous joints. While the joining zones 16*a* and 16*b* in the foregoing embodiments are parallel with the direction of inserting the holder 20, they may be nonparallel with the direction of inserting the holder 20 as long as they extend in that direction. While in the described embodiments, the pair of bumping joints 18*a* and 18*b* providing the counter bumping portion 18 are each circular in a plan view and independent of the joints 17 adjacent thereto, each of the bumping joints 18*a* and 18*b* may be linked to the adjacent joints 17 as illustrated in FIG. 13. The counter bumping portion 18 does not always have to have a pair of the bumping joints 18*a* and 18*b*. Only one of the pair can serve. In this embodiment, the bumping portion 23 of the insertion portion 22 may be provided on only one side thereof, in which case the insertion portion 22 should be inserted into the pocket 15 with the side of the former having the bumping portion 23 being aligned with the side of the latter having the bumping joint 18*a* or 18*b*.

Figure 14A:
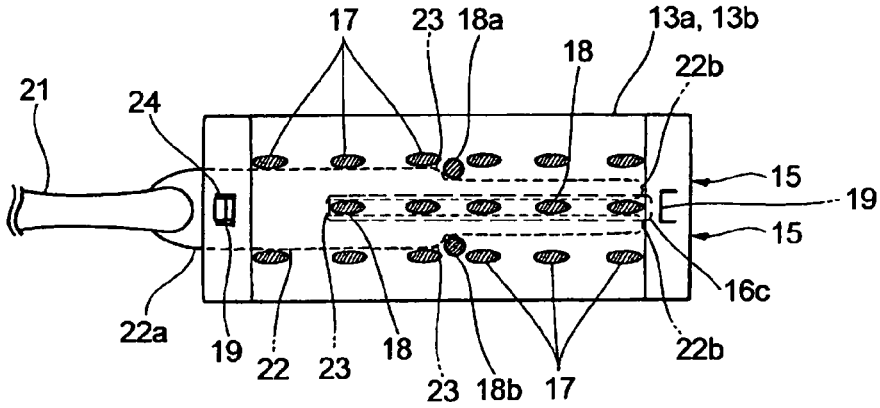
FIG. 14(*a*) is a plan view of a pair of substrate sheets of a cleaning article of a cleaning implement according still another embodiment of the present invention, with a holder being inserted therebetween.
Figure 14B:
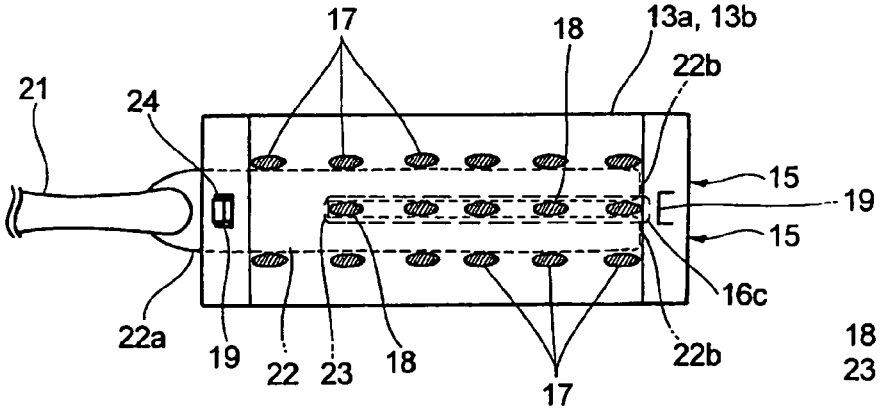
Figure 14C:
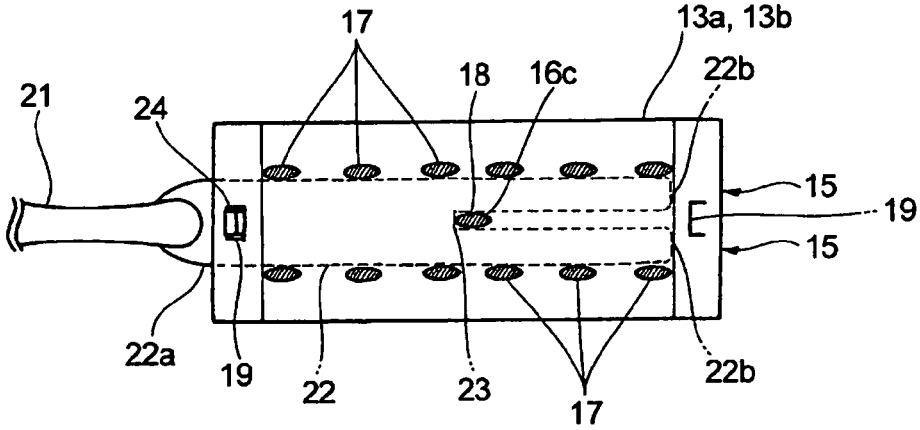

The insertion portion 22 may be forked into two tines as illustrated in FIGS. 14(*a*) to (*c*). In this embodiment, the pocket 15 preferably has an additional joining zone 16*c* extending in the longitudinal direction of the mop 10 in the laterally middle portion of the pocket 15 so as to guide insertion of the two-forked tines.

In the case where the insertion portion 22 is forked in the middle portion, preferably at the center, between the proximal end 22*a* and the distal end 22*b* into two tines each extending to the distal end 22*b*, the bifurcation functions as a bumping portion 23, and a bumping joint is formed at the central position of the pocket 15 to serve as a counter bumping portion 18. The counter bumping portion 18 is made to bump against the bifurcation between the two tines (flat sticks or round sticks). The bumping joint may be provided only at the center in the direction of inserting the insertion portion 22, such as the joining zone 16*c* illustrated in FIG. 14(*c*). According to the configuration described, the insertion portion 22 does not have a bumping portion on its side edge(s) but has the bifurcation function as the bumping portion 23 which is to bump against the joining zone 16*c* provided in the center of the pocket 15 as a counter bumping portion 18. Because the bifurcation (bumping portion 23) bumps against the counter bumping portion 18 not at the end (inlet opening) but inside of the pocket 15, the means for restricting the longitudinal movement of the insertion portion 22 is shared by the engaging means 19 and the bifurcation (bumping portion 23). As a result, the pocket 15 is prevented from twisting, breaking or wrinkling at its inlet opening.

The joining zones 16*a* and 16*b* of the pocket 15 in the foregoing embodiments that are each formed by spacedly aligned spot joints may be replaced with those formed by spacedly aligning linear joints. While in the foregoing embodiments, the fiber layers 11*a* to 11*d* forming the mop 10 are each formed out of a fiber bundle (tow), each of them may be formed out of continuous fibers, in which case the continuous fibers of each fiber layer are preferably fuzzed so that the mop 10 takes on a nearly cylindrical shape as a whole. Materials of the continuous fibers include polyethylene terephthalate (PET), polypropylene (PP), polyethylene (PE), and PET/PE. The continuous fibers preferably have a length of 50 to 200 mm, more preferably 60 to 120 mm, and a thickness of 0.5 to 5 dtex, more preferably 1 to 3 dtex.

The number of the fiber layers is not particularly limited.

While the insertion portion 22 of the holder 20 used in the fourth embodiment has a circular cross-section, it may have an elliptic, elongated circular or a polygonal (e.g., a triangular or a rectangular) cross-section. The insertion portion 22 of the fourth embodiment may have a pair of sticks 221 extending practically parallel to each other. The paired sticks 221 are connected to each other at their tips 222. The insertion portion 22 has a pair of hooks as a retaining means 24 on the outboard side thereof near the bases 223 of the respective sticks 221. The distance between the respective tips 241 of the paired hooks is larger than the size of the inlet opening of the pocket 15. The paired sticks 221 are deflectable to narrow the gap between the respective bases 223.

The retaining means 24 is not limited to the above-described hooks, and various retaining means can be employed, including a hook-and-loop fastener and an elastic plate member having a slit into which an end of the pocket 15 is pinched.

The mop 10 of the present invention may have the following structure. The mop 10 has a pocket 15 in which the insertion portion 22 of the holder 20 is insertable and a counter bumping portion 18 that is adapted to bump against a part of the insertion portion 22 being inserted to restrict further insertion of the insertion portion 22 beyond the bumping position. The pocket 15 is formed by joining substrate sheets 13 overlying each other. The substrate sheets 13 have a plurality of joining zones 16, each formed by spacedly aligning joints 17 along imaginary lines practically parallel to each other and extending from one end to the other end of the sheets 13 in the direction of inserting the holder 20. The counter bumping portion 18 is between two adjacent joining zones 16 at a middle position in the direction of inserting the insertion portion 22. The counter bumping portion 18 is formed of a joint in which the substrate sheets 13 are partly joined together.

Particulars of one embodiment that have been omitted to avoid redundancy can appropriately be complemented by the corresponding description of other embodiments. Particulars characteristic of one embodiment can apply to other embodiments appropriately.

The cleaning implement according to the present invention is used usually in a dry state to clean furniture such as tables, desks, and drawers, appliances such as TV sets, VCRs, and refrigerators, and like objects. It is also useful to clean hard-to-reach areas such as corners of rooms and tight spaces between a wall and furniture.

INDUSTRIAL APPLICABILITY

The present invention provides a cleaning implement including a holder and a cleaning article. The holder is easily inserted into the pocket of the cleaning article to stably hold the cleaning article and is easily removed from the pocket of the cleaning article.

The invention claimed is:

1. A cleaning implement comprising a cleaning article having a pocket and a holder adapted to be inserted into the pocket of the cleaning article to hold the cleaning article, the pocket of the cleaning article having an inlet opening through which the holder is to be inserted at one end thereof and the opposing end in the direction of inserting the holder and having a counter bumping portion in the middle between the inlet opening and the opposing end, the holder comprising a handle, an insertion portion extending from one end of the handle and adapted to be inserted into the pocket of the cleaning article, and a retaining means adapted to retain the vicinity of the inlet opening of the cleaning article when the insertion portion is inserted into the pocket, the insertion portion of the holder having a bumping portion that allows the insertion portion to be inserted into the pocket with no substantial obstruction until it reaches a bumping position where it bumps against the counter bumping portion of the pocket and then restricts further insertion of the insertion portion beyond the bumping position, the cleaning article being substantially prevented from moving between the bumping portion and the retaining means while having the insertion portion inserted in the pocket thereof and being retained by the retaining means, wherein the bumping portion is a part formed by making a difference in width or cross-sectional area of the insertion portion in the middle between the proximal end and the distal end of the insertion portion to provide a region distal to the bumping portion and a region proximal to the bumping portion, the counter bumping portion is a part of the pocket into which the insertion portion is adapted to be inserted, the part having a smaller width or area than the inlet opening, the region of the insertion portion distal to the bumping portion having a width or cross-sectional area equal to or smaller than that of the counter bumping portion and being insertable through the counter bumping portion, and the region of the insertion portion proximal to the bumping portion having a width or area equal to or smaller than that of the inlet opening of the pocket and a width or cross-sectional area larger than that of the counter bumping portion.

2. The cleaning implement according to claim 1, wherein the cleaning article comprises substrate sheets overlying each other, and the pocket is formed of the substrate sheets.

3. The cleaning implement according to claim 2, wherein the pocket is formed by joining the overlying substrate sheets at joints spacedly aligned in the direction of inserting the insertion portion of the holder.

4. The cleaning implement according to claim 2, wherein the cleaning article further comprises a fiber layer comprising a tow or continuous fibers superposed on the substrate sheets comprising a nonwoven fabric.

5. The cleaning implement according to claim 4, wherein the cleaning article has the fiber layer on the outer side of each of the substrate sheets, the tow or continuous fibers of the fiber layer being fuzzed.

6. The cleaning implement according to claim 1, wherein the retaining means of the holder is provided near the border between the insertion portion and the handle, and the cleaning article has an engaging means near the inlet opening, the engaging means being adapted to engage with the retaining means.

7. The cleaning implement according to claim 1, wherein the pocket of the cleaning article has the inlet opening at both ends thereof in the direction of inserting the holder so that the holder inserted into the pocket from whichever inlet opening bumps against the counter bumping portion and retains the vicinity of the inlet opening of the cleaning article by the retaining means thereof.

8. The cleaning implement according to claim 1, wherein the insertion portion comprises a pair of stick portions connected to each other at their respective ends opposite to their handle-sided ends and the retaining means of the insertion portion is a pair of projections projecting outward from each of the stick portion near the handle, the distance between the opposing tips of the projections being larger than the width of the inlet opening of the pocket, and the paired stick portions being deflectable to reduce the distance between the pair of projections.

9. The cleaning implement according to claim 8, wherein each of the stick portions has an actuating portion on the outer edge of the handle-sided end thereof, the actuating portion being configured to be pushed inboard to reduce the distance between the opposing tips of the projections.

10. The cleaning implement according to claim 1, wherein the cleaning article comprises substrate sheets overlying each other, and the pocket is formed of the substrate sheets, the pocket is formed by joining the overlying substrate sheets at joints spacedly aligned in the direction of inserting the insertion portion of the holder, and the joints are formed in a dot-shape.

11. The cleaning implement according to claim 10, wherein at least two of the joints are formed at the counter bumping portion.

* * * * *